US009598094B2

(12) United States Patent
Miller et al.

(10) Patent No.: US 9,598,094 B2
(45) Date of Patent: Mar. 21, 2017

(54) METHOD AND SYSTEM FOR EVENT RECORDER PLAYBACK

(71) Applicant: Progress Rail Services Corporation, Albertville, AL (US)

(72) Inventors: Marc David Miller, Lee's Summit, MO (US); Steven Keith Kirby, Holden, MO (US); Gregory Richard Bressler, Summerdale, PA (US)

(73) Assignee: Progress Rail Services Corporation, Albertville, AL (US)

( * ) Notice: Subject to any disclaimer, the term of this patent is extended or adjusted under 35 U.S.C. 154(b) by 0 days.

(21) Appl. No.: 14/500,266

(22) Filed: Sep. 29, 2014

(65) Prior Publication Data

US 2016/0090111 A1 Mar. 31, 2016

(51) Int. Cl.

| | |
|---|---|
| ***B61L 3/00*** | (2006.01) |
| ***B61L 15/00*** | (2006.01) |
| ***B61C 17/12*** | (2006.01) |

(52) U.S. Cl.

CPC ..... *B61L 15/0081* (2013.01); *B61C 17/12* (2013.01); *B61L 3/002* (2013.01); *B61L 15/0072* (2013.01)

(58) Field of Classification Search

CPC .. B61L 3/006; B61L 15/0027; B61L 15/0081; B61L 2205/04; B61L 15/0036; B61L 25/025; B61L 27/0027; B61L 27/0094; B61L 15/0054; B61L 23/34; B61L 27/0005; B61L 27/0022; B61L 27/0055; B61L 3/00; B61L 3/004; B61L 3/127; B61C 17/12; B61C 17/00; B61C 17/04; B61C 3/00

See application file for complete search history.

(56) References Cited

U.S. PATENT DOCUMENTS

| | | | | |
|---|---|---|---|---|
| 5,530,328 | A | 6/1996 | Fernandez et al. | |
| 6,947,797 | B2 * | 9/2005 | Dean | B61C 17/04 700/110 |
| 6,959,235 | B1 * | 10/2005 | Abdel-Malek | B61L 27/0094 340/988 |
| 7,051,044 | B1 * | 5/2006 | Fera | B61L 27/0094 |
| 7,618,011 | B2 | 11/2009 | Oleski et al. | |
| 8,154,227 | B1 * | 4/2012 | Young | A63H 19/24 318/255 |
| 8,521,345 | B2 | 8/2013 | Cooper et al. | |
| 8,532,148 | B2 * | 9/2013 | Homma | G04C 13/02 370/503 |
| 9,132,846 | B2 * | 9/2015 | Przybylski | B61L 15/0027 |

(Continued)

*Primary Examiner* — Truc M Do

(74) *Attorney, Agent, or Firm* — Finnegan, Henderson, Farabow, Garrett & Dunner, LLP

(57) ABSTRACT

An event recorder playback system for a plurality of locomotives in a consist is described, including a processor configured to receive and save a first dataset and a second dataset associated with operation of a first locomotive and a second locomotive, respectively, in the consist. The processor may determine, using the processor, a point of synchronization of the first dataset and the second dataset with respect to time, and align the first dataset and the second dataset using the point of synchronization. The event recorder playback system may be further configured to output the first dataset and the second dataset on an output device. The output is aligned with respect to time.

19 Claims, 3 Drawing Sheets

(56) References Cited

U.S. PATENT DOCUMENTS

| | | | | |
|---|---|---|---|---|
| 2004/0100938 | A1* | 5/2004 | Aiken, II | B61L 3/127 370/346 |
| 2004/0249571 | A1* | 12/2004 | Blesener | B61L 29/28 701/301 |
| 2005/0253926 | A1* | 11/2005 | Chung | B61L 15/0027 348/148 |
| 2006/0031590 | A1* | 2/2006 | Monette | B61L 15/0036 709/249 |
| 2006/0138285 | A1* | 6/2006 | Oleski | B61L 25/025 246/167 R |
| 2007/0124332 | A1* | 5/2007 | Ballesty | B61L 27/0094 |
| 2007/0233335 | A1 | 10/2007 | Kumar et al. | |
| 2008/0258909 | A1* | 10/2008 | Meyer | B61L 3/002 340/539.25 |
| 2009/0173839 | A1* | 7/2009 | Groeneweg | B61L 23/042 246/15 |
| 2011/0075641 | A1* | 3/2011 | Siriwongpairat | B61L 27/0005 370/337 |
| 2011/0099413 | A1* | 4/2011 | Cooper | B61L 15/0027 714/4.1 |
| 2012/0203402 | A1* | 8/2012 | Jape | B61L 27/0027 701/19 |
| 2014/0222971 | A1* | 8/2014 | Cooper | H04L 67/12 709/219 |
| 2015/0021444 | A1* | 1/2015 | Goergen | G06F 3/0604 246/122 R |

* cited by examiner

METHOD AND SYSTEM FOR EVENT RECORDER PLAYBACK

TECHNICAL FIELD

This disclosure relates generally to event recorders and, more specifically, to a system and method for data playback associated with event recorders.

BACKGROUND

Locomotives may include a system for receiving and logging operational data for use in troubleshooting or diagnosing a locomotive failure. These systems may include an event recorder that collects and communicates vehicle performance data received from multiple subsystems within the locomotive. An important purpose of the event recorder is to provide a source of data that can be retrieved from the event recorder after an event such as an accident, and provide a detailed and accurate accounting of exactly what happened leading up to and during the event. In some systems, the data is collected periodically or in response to a triggering event or fault condition. Each locomotive may have its own event recorder.

If an accident occurs, such as a derailment, crash, or other mishap, the event recorder data may be useful to help determine the cause of the event, or conditions that may have contributed to the event. Playback software for event recorder data may be used to read and process data. Currently, event recorder playback is carried out using data from one locomotive at a time. However, trains (consists) may be made up of multiple locomotives, where each event recorder may independently record data from each respective locomotive. While data from each event recorder may provide an independent set of information with respect to the event, it may be desirable to provide an event recorder playback system that provides playback and analysis of recorder data from multiple locomotives in a consist. It may also be desirable to provide a system that can receive, save, and process the data from multiple locomotives, and synchronize the data with respect to time for analysis of an event that has been recorded by a plurality of event recorders.

One system for rail vehicle time synchronization is disclosed U.S. Pat. No. 8,524,345 ("the '345 patent"). The '345 patent describes a communication method that includes communicating with a second system from a first system, and "syncing" the systems by establishing a mutual clock. Although the system provided by the '345 patent may provide for establishing a mutual clock between two locomotive control systems in a consist, it may be less than optimal. In particular, the '345 patent does not provide a system that allows for playing back recorded data from multiple recorders in the same consist. Additionally, the '345 does not align the datasets recorded in each of a plurality of event recorders to a common point of synchronization, nor does it provide a system for analysis and playback of the aligned event recorder datasets.

The presently disclosed systems and methods are directed to overcoming and/or mitigating one or more of the possible drawbacks set forth above and/or other problems in the art.

SUMMARY

In accordance with one aspect, the present disclosure is directed to an event recorder playback system for a plurality of locomotives in a consist, including a processor configured to receive and save a first dataset and a second dataset associated with operation of a first locomotive and a second locomotive, respectively, in the consist, determine, using the processor, a point of synchronization of the first dataset and the second dataset with respect to time, and align, using the processor, the first dataset and the second dataset using the point of synchronization. The event recorder playback system may be further configured to output the first dataset and the second dataset on an output device. The output is aligned with respect to time.

In accordance with another aspect, the present disclosure is directed to a computer-implemented method for operating an event recorder playback system for a plurality of locomotives in a consist, including receiving and saving, via a processor, a first dataset and a second dataset associated with operation of a first locomotive and a second locomotive, respectively, in the consist, determining, using the processor, a point of synchronization of the first dataset and the second dataset with respect to time, and aligning, using the processor, the first dataset and the second dataset using the point of synchronization. The computer-implemented method may further include outputting the first dataset and the second dataset on an output device. The output is aligned with respect to time.

In accordance with another aspect, the present disclosure is directed to a non-transitory computer-readable storage medium storing program code. The computer-readable medium may be operable to cause a processor to, when executed, receive and save a first dataset and a second dataset associated with operation of a first locomotive and a second locomotive, respectively, in a consist, determine a point of synchronization of the first dataset and the second dataset with respect to time, and align the first dataset and the second dataset using the point of synchronization. The storage medium may also cause the processor to output the first dataset and the second dataset on an output device. The output is aligned with respect to time.

DETAILED DESCRIPTION

Figure 1:
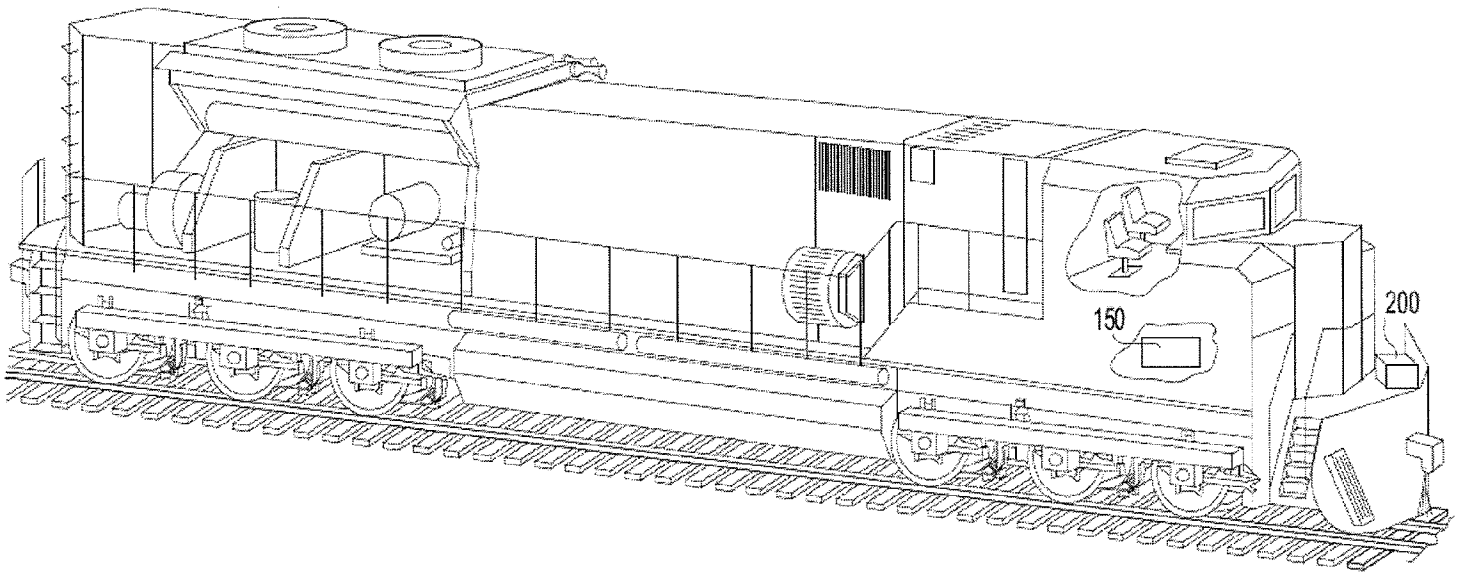
FIG. 1 is a perspective view of an exemplary embodiment of a locomotive.

FIG. 1 shows an exemplary locomotive 100 in which systems and methods for recording events may be implemented consistent with the disclosed exemplary embodiments. Locomotive 100 may include a power system 150 for powering locomotive 100. In one embodiment, power system 150 may include, for example, a uniflow two-stroke diesel engine system. Power system 150 may also include controls for designating the direction, speed, and braking of locomotive 100. Power system 150 may have a power characteristic that describes a current property of power system 150. The power characteristic may include, for example, temperature, power level, fuel efficiency, and fuel level. The power characteristics may also define characteristics of the vehicle (e.g., locomotive 100) as they relate to power. For example, power characteristics may also be indicative of vehicle speed and/or the operation mode associated with the vehicle. For example, the operation mode may include an OFF mode and an ON mode. The ON mode may be one or more of a power mode, a secondary power mode, a dynamic braking mode, a blended brake mode, an emergency brake mode, a rollback mode, and an opposite-direction brake mode.

In addition to power system 150, locomotive 100 may also include a recording system 200 for obtaining and storing signal data. According to some embodiments, at least a portion of recording system 200 may be located at or near the front of locomotive 100. Recording system 200 may include one or more cameras (not shown) for capturing images. The cameras may be one or more front-facing cameras positioned behind the nose windshield of locomotive 100, or positioned in one or more other directions, and configured to record the surrounding environment of locomotive 100. The cameras may be video cameras capable of capturing a continuous stream of images, and/or may be configured to record images periodically.

Recording system 200 may also provide one or more microphones (not shown) for recording audio data. The microphones may be positioned to record audio data from the interior control area of locomotive 100, and/or positioned at various locations on the exterior of locomotive 100. According to one aspect, recording system 200 may record voice (speech) data, auditory signal data (for example, the signal sounded from a railway asset such as a train crossing signal), auditory data of the function of a component (for example, the sound of an air brake operating), and/or other auditory data from the operational environment of locomotive 100. For example, recording system 200 may record the sound of a car horn, or some other environmental sound.

Recording system 200 may include one or more controllers (not shown), which may perform data storage with one or more of a plurality of controllers and/or storage devices (not shown). According to one aspect, the controller may be one portion of a locomotive power controller configured to operate locomotive 100. Recording system 200 may record operational data (e.g., dataset 302, depicted in FIG. 3) in connection with the operation of locomotive 100. Operational data may include, for example, travel velocity, time information, date information, geographic information, GPS (Global Positioning System) information, an alarm status, a power level, audio recording data, and/or other control information in connection with the operation of locomotive 100.

Operational data may also include signal information, including information with respect to the initiation and transmission of a signal, and the receipt of the signal. For example, recording system 200 may record a signal issued by an operating system of locomotive 100 to actuate the air brake system (not shown) of the locomotive. Recording system 200 may record the time at which the signal was transmitted to the receiving component (e.g., the air brake control module), when the air brake control module received the signal, and when the corresponding action is taken by the receiving control module. Each respective recording system may save operational data in connection with each of the locomotives in the consist. For example, datasets 302, 304 and 306 may contain operational data from locomotive 301, locomotive 303, and locomotive 305, respectively.

Recording system 200 may be configured to store datasets to a plurality of controllers and/or non-volatile memory stores (not shown). In one aspect, each of the operatively connected controllers (each containing or connected to a respective memory store) may both send data in connection with its own operation, and simultaneously receive data in connection with the operation of each of the other respective locomotives. Each of the connected controllers in the consist may be operably connected through a communication network (not shown). In another aspect, each of the operatively connected controllers may redundantly store the data from the other controllers.

Although a plurality of data recorders operating in a consist may be operatively connected to share and/or transmit operational data to one another for the purpose of redundant data storage, each respective controller may operate independently as a separate computing device. For example, according to one embodiment, each of the data recorders operating in a consist may store its respective dataset according to the computer clock time of each controller. In this respect, the datasets stored on the connected controllers may not be synchronized with each other with respect to time. According to another embodiment, the connected controllers may be connected for communication and/or data transmission, and also share a common system clock. In one aspect, each of the datasets may be synchronized with each other with respect to time.

Figure 3:
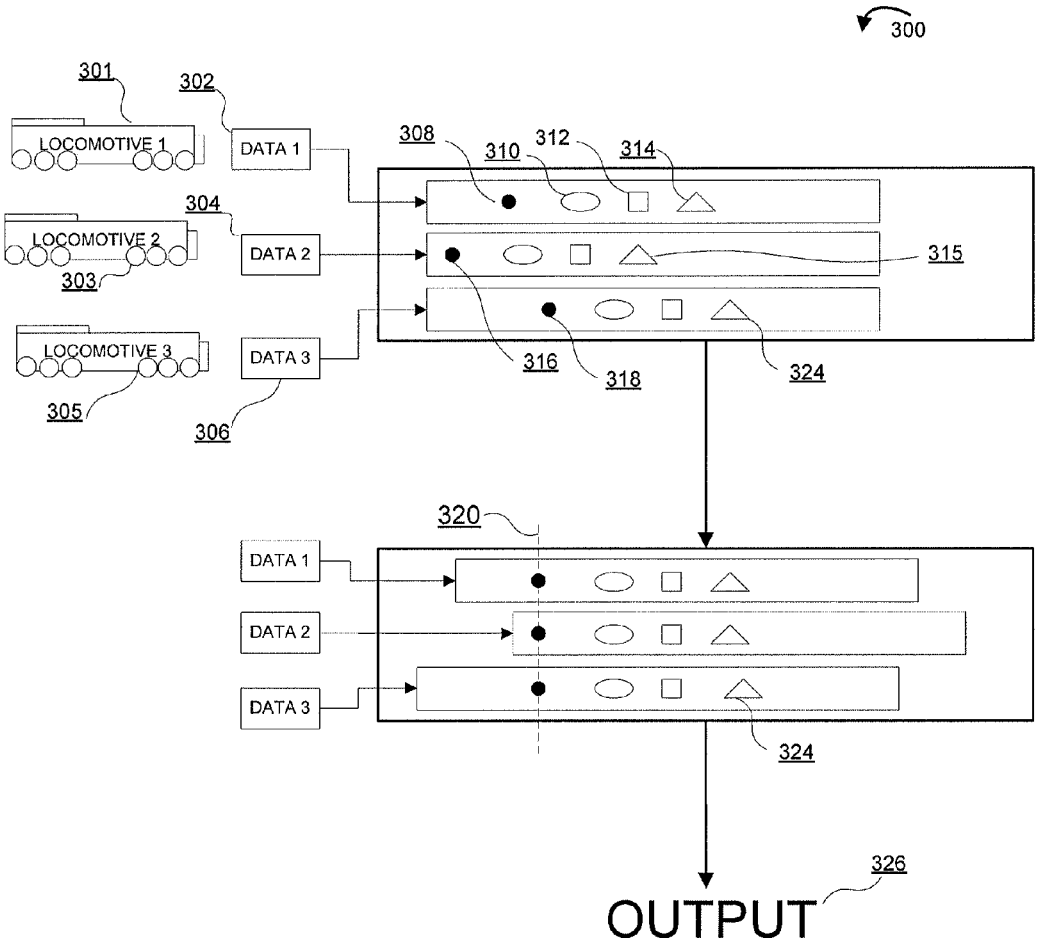
FIG. 3 is a schematic diagram of an exemplary embodiment of an event recorder playback system.

Recording system 200 may embody a single processor or multiple processors that include a means for receiving data signals and storing and/or communicating at least a portion of time-stamped data signals. Recording system 200 may include all components required to run an application, such as, for example, a memory, a secondary storage device, and a processor, such as a central processing unit or other known means. Recording system 200 may include a data recorder playback system (for example, event recording playback system 300 as depicted in FIG. 3), and may include an operatively connected output device (not shown). Recording system 200 may also include a computer-readable storage medium storing program code operable to cause a processor to, when executed, perform the data storage operations described herein. Various other known circuits may be associated with recording system 200, including power source circuitry (not shown) and other appropriate circuitry. Recording system 200 may be capable of receiving data signals as well as logging commands. Recording system 200 may also include one or more non-transitory computer-readable storage media for data storage as described in exemplary embodiments herein.

In general, when multiple locomotives are operatively connected in a consist, the first locomotive (e.g., locomotive 301) may have master control of power characteristics associated with the other two locomotives, such as control of acceleration, braking, etc. Accordingly, the second and third locomotives (e.g., 303 and 305) may receive the signal transmission from the first locomotive 301, and respond to the issued signals by braking, accelerating, etc. When the operating systems of a consist function correctly, all of the operatively connected locomotives respond in unison to the signals issued by the lead locomotive. Each respective locomotive may include an event recorder configured to record operational data in connection with the operation of the locomotive, including recording the signal data.

According to some embodiments, the event recorders may operate independently. For example, in a consist with three locomotives, each event recorder may record data that is not time-synchronized with the other two recorders. When the three event recorders have distinct and separate system clocks, it may not be possible to determine, from an analysis of the three disparate data sets, whether there has been a malfunction between the issuance of a control signal from the lead locomotive, and the corresponding receipt and response to the signal at the second and/or third locomotives.

For example, a first event recorder located on the first locomotive (e.g., an event recorder operating as part of recording system 200, located on locomotive 100) may record operational data in connection with an adverse event (for example, a collision with another vehicle). The recording of the first operational data, recorded on locomotive 100, may contain video data of the event, such as video data showing a vehicle intersecting the path of the consist. Recording system 200 may record the event according to the system clock time of recording system 200, at Time 1. Recording system 200 may further record data indicating the sounding of a warning horn initiated and sounded at Time 2, data indicating the transmission of a control signal initiating from the first locomotive to the air brake controller located on the first locomotive at Time 3, data indicating the receipt of the signal at the air brake controller of the first locomotive at Time 4, and data indicating the actuation of the first locomotive air brake at Time 5. In this example, the controller on the second locomotive (e.g., 303), is also recording a second dataset. The second dataset (e.g., 304) may also contain recorded information about the same event (the vehicle intersecting the consist), but from the perspective of the second controller in the second locomotive 303, and with respect to the system clock of its own controller. Additionally, the second event recorder may not have data indicating the transmission of the control signal to brake, but rather, contain information about the receipt of a control signal from locomotive 100 and the corresponding response by the receiving locomotive (e.g., actuation of the air brake on locomotive 303). Accordingly, the data recorders on the second locomotive 303 may record the same event (the vehicle intersecting the consist), but the recordings of the first and second datasets (e.g., 302 and 304) may not be aligned with each other with respect to a common clock time (a point of synchronization). If an analysis of the two datasets is conducted, without aligning the datasets with respect to a point of synchronization, the comparison may not provide useful information indicating a malfunction of an operating system of one or more of the first locomotive and the second locomotive.

Figure 2:
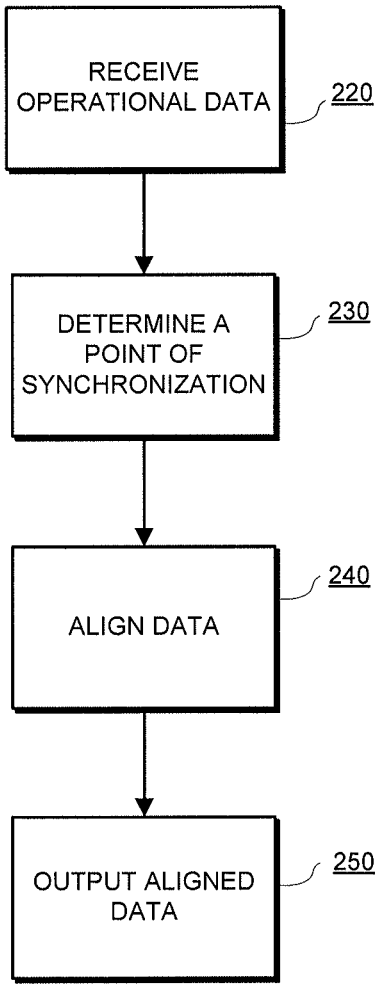
FIG. 2. is a flowchart of an exemplary embodiment of a method for controlling an event recorder playback system.

FIG. 2 depicts a method of operating an exemplary event recording playback system that may overcome these limitations. According to some embodiments, the event recorder playback system may receive operational data from one or more event recorders and save the data to a non-transitory, computer-readable storage device (step 220). The operational data may include, for example dataset 302, dataset 304, and dataset 306, as depicted in FIG. 3, which may be recorded by event recorders on each of the three locomotives 301, 303, and 305 in the same consist.

After receiving and saving datasets 302, 304, and 306, system 300 may determine, using the processor, a point of synchronization between the datasets with respect to time (step 230). A point of synchronization may be a data point that is common with each dataset, where each of the plurality of datasets may be aligned with respect to the point in time. For example, the first dataset may contain information regarding an event. The other two datasets may also contain records of the same event, from the perspective of the two other event recorders in the consist. According to one embodiment depicted in FIG. 3, dataset 302 may contain information associated with operation of a first locomotive 301. Dataset 302 may contain information regarding an event 308, such as, for example, video data 310 containing a video recording of a vehicle approaching and intersecting the path of locomotive 301. Video data 310 may also show a view of the railroad crossing block that has properly lowered as locomotive 301 approaches an intersection. Dataset 302 may also contain audio data 312, including a recording of the railroad crossing signal sounding as the locomotive approaches, audio data 312 of the warning horn sounding by the locomotive operator, and a recording of the air brakes engaging. Dataset 302 may also include signal data 314, which may contain a record of the transmission of signals to and from operating systems of locomotive 301. Each of datasets 302, 304, and 306 may provide information in connection with event 308.

FIG. 3 depicts an exemplary recording playback system 300. System 300 may determine a point of synchronization based on video data indicative of a geographic location. For example, video data 310 may include data showing a mile marker indicator indicating that the lead locomotive has reached a particular location. System 300 may use the mile marker information for synchronization. According to another embodiment, a combination of GPS (Global Positioning System), audio, video, and signal data may be used to determine a point of synchronization. For example, system 300 may use signal data indicating brake actuation in conjunction with audio data indicating the actuation of the brakes. Video data may also be used to visually confirm a point in time where the air is expelled from the air brakes.

Datasets 304 and 306, which were recorded at the same time at a corresponding one of the second locomotive 303 and the third locomotive 305, may contain information regarding the same event (316 and 318, respectively), but from the perspective of the event recorders on which the datasets were recorded. In this respect, events 308, 316, and 318 are the same event (or more precisely, they are the data associated with the same event), but recorded from the perspective of each corresponding event recorder. According to one embodiment, system 300 may receive and save the data (e.g., dataset 302) associated with the first locomotive 301, the data (e.g., dataset 304) associated with the second locomotive 303, and the data (e.g., dataset 306) associated with the third locomotive 305, and save the data to an operatively connected computer memory.

System 300 may determine a point of synchronization 320 of the each of the datasets 302, 304, and 306 (step 230). System 300 may determine a point of synchronization 320 in a number of ways. For example, dataset 302 may include video data 310, audio data 312, and signal data 314. System 300 may use any of video data, audio data and signal data to determine a point of synchronization 320, which may be a point of temporal alignment for all of datasets 302, 304, and 306.

System 300 may align the datasets with respect to the point of synchronization (step 240). As depicted in FIG. 3, each of datasets 302, 304, and 306 may be aligned such that each of the video data 310, audio data 312 and signal data 314 may be aligned with respect to time. That is to say, each of events 308, 316, and 318 reflect the same event in time, and each respective dataset may be analyzed in parallel with the other datasets.

According to some embodiments, system 300 may be configured to analyze a difference between the aligned first dataset, the second dataset and the third dataset, to determine causation of the event. For example, by comparing signal data between datasets 302, 304, and 306, system 300 may determine that a signal to actuate the air brakes was sent from the first locomotive 301, and was received by the second and third locomotives (303, 304) simultaneously. However, it may be determined, by comparing the datasets, that the time of brake actuation in the third locomotive (depicted as 324 in FIG. 3) was delayed by four seconds in comparison to the first and second locomotives. According to some embodiments, system 300 may analyze the difference between the datasets to determine the causation of the event of striking the vehicle in the path of the consist. According to other embodiments, system 300 may receive input instructing the system to search and find the differences between datasets 302, 304, and 306. For example, user input may input instructions for system 300 to search and find signal delays greater than 10 ms. Accordingly, system 300 may perform a search of datasets 302, 304, and 306, and return results indicating signals meeting the search criteria.

System 300 may also be configured to analyze redundantly stored data from a plurality of synchronized event recorders operating on the plurality of locomotives operating in the consist. For example, system 300 may be configured to automatically retrieve redundantly stored data from a plurality of data recorders, and determine any data that may be different between datasets.

Referring again to FIG. 2, system 300 may output the first dataset and the second datasets on an output device (step 250), where the output 326 is aligned with respect to time. For example, system 300 may include graphic representations of the signal data 314 from first locomotive 301, signal data 315 from the second locomotive 303, and signal data 324 from the third locomotive 305. As another example, output 326 may depict each of the signal datasets overlaid on or next to one another, with a graphical representation of the audio data from one or more of datasets 302, 304, and/or 306 in the same view. In one aspect, system 300 may compare the datasets to determine a malfunction of an operating system of one or more of the locomotives. According to one embodiment, system 300 may output each of the video feeds on the screen at the same time, where the feeds are aligned with respect to time. According to another embodiment, system 300 may be configured to output human-readable data that indicates a difference between the datasets. For example, signal data may be presented in a human-readable format, such as a spectrograph or a time-domain representation of the signal data. As another example, audio data may be human-readable by a graphical representation of the data. Other methods of output are contemplated, where the output may indicate causation (or lack of causation) of an event.

INDUSTRIAL APPLICABILITY

The disclosed systems and methods may provide a robust mechanism for event recorder playback. The presently disclosed systems and methods may have several possible advantages. For example, this system may provide means for comparing separately recorded information in connection with a rail accident, and provide additional insight into the cause of the accident. The presently disclosed system may also provide multiple layers of data that may confirm causation or a lack of causation, showing whether the operating systems on a locomotive and/or consist have operated consistently with their intended use.

The disclosed systems and methods may also provide a robust mechanism for determining a malfunction of an operating system of one or more locomotives in a consist. For example, if a consist has a decrease in power output due to a systematic malfunction of only one of the locomotives, such as a brake malfunction, the disclosed systems and methods may provide an additional layer of data that may be useful for diagnosis of the malfunction. Moreover, this system may decrease the time and resources needed to determine an appropriate solution.

It will be apparent to those skilled in the art that various modifications and variations may be made to the disclosed systems and methods for event recorder playback. Other embodiments of the present disclosure will be apparent to those skilled in the art from consideration of the specification and practice of the present disclosure. It is intended that the specification and examples be considered as exemplary only, with a true scope of the present disclosure being indicated by the following claims and their equivalents.

What is claimed is:

1. An event recorder playback system, comprising:

a first locomotive and a second locomotive associated with a plurality of locomotives in a consist, each of the first and second locomotives configured with memory to store at least one dataset;

a communication network to connect the first locomotive and the second locomotives to one another to facilitate communication of the at least one dataset; and a processor, in communication with the first and second locomotive via the communication network, configured to:

evaluate a first dataset associated with operation of the first locomotive and a second dataset associated with the operation of the second locomotive, determine a point of synchronization of the first dataset and the second dataset with respect to time, align the first dataset and the second dataset using the point of synchronization, and output the first dataset and the second dataset on an output device, wherein the output is aligned with respect to time.

2. The event recorder playback system of claim 1, wherein the processor is further configured to align the first dataset and the second dataset by identifying an event that occurs in each of the first dataset and the second dataset.

3. The event recorder playback system of claim 2, wherein the processor is further configured to analyze a difference between the aligned first dataset and the second dataset to determine causation of the event.

4. The event recorder playback system of claim 3, wherein the processor compares the first dataset and the second dataset to determine a malfunction of an operating system of one or more of the first locomotive and the second locomotive.

5. The event recorder playback system of claim 4, wherein determining the malfunction includes identifying a delay between a transmission of a signal at the first locomotive and a corresponding response at the second locomotive.

6. The event recorder playback system of claim 1, wherein the point of synchronization is determined based on video data indicative of a geographic location.

7. The event recorder playback system of claim 1, wherein the point of synchronization is identified based on audio data.

8. The event recorder playback system of claim 7, wherein the processor is configured to search and find differences between the first dataset and the second dataset.

9. The event recorder playback system of claim 2, wherein the first dataset and the second dataset include redundantly stored data, and the processor is configured to analyze the redundantly stored data.

10. The event recorder playback system of claim 2, wherein the output includes human-readable data that indicates a difference between the first set of data and the second set of data.

11. A computer-implemented method for operating an event recorder playback system, comprising:

storing, in memory, at least one dataset associated with a first locomotive and a second locomotive of a plurality of locomotives in a consist;

connecting, via a communication network, the first locomotive and the second locomotive to one another to facilitate communication of the at least one dataset, evaluating, via a processor, a first dataset and a second dataset of the at least one dataset, wherein the first dataset and the second dataset being associated with an operation of a first locomotive and a second locomotive, respectively, in the consist;

determining, using the processor, a point of synchronization of the first dataset and the second dataset with respect to time;

aligning, using the processor, the first dataset and the second dataset using the point of synchronization; and outputting the first dataset and the second dataset on an output device, wherein the output is aligned with respect to time.

12. The computer-implemented method of claim 11 wherein the processor is further configured to align the first dataset and the second dataset by identifying an event that occurs in each of the first dataset and the second dataset.

13. The computer-implemented method of claim 12, wherein the processor is further configured to analyze a difference between the aligned first dataset and the second dataset to determine causation of the event.

14. The computer-implemented method of claim 13 wherein the processor compares the first dataset and the second dataset to demine a malfunction of an operating system of one or more of the first locomotive and the second locomotive.

15. The computer-implemented method of claim 14 wherein determining the malfunction includes identifying a delay between a transmission of a signal at the first locomotive and a corresponding response at the second locomotive.

16. The computer-implemented method of claim 11 wherein the point of synchronization is determined based on video data indicative of a geographic location.

17. The computer-implemented method of claim 11 wherein the point of synchronization is identified based on audio data.

18. The computer-implemented method of claim 11 wherein the processor is configured to search and find differences between the first dataset and the second dataset.

19. The computer-implemented method of claim 11 wherein the first dataset and the second dataset include redundantly stored data, and the processor is configured to analyze the redundantly stored data.

* * * * *